US005636686A

United States Patent [19]

Wittrisch

[11] Patent Number: 5,636,686

[45] Date of Patent: Jun. 10, 1997

[54] MEASURING ASSEMBLY COMPRISING MEANS FOR ORIENTING A PART OF THE MEASURING ELEMENTS

[75] Inventor: Christian Wittrisch, Rueil Malmaison, France

[73] Assignee: Institut Francais du Petrole, Rueil-Malmaison, France

[21] Appl. No.: 498,345

[22] Filed: Jul. 5, 1995

[30] Foreign Application Priority Data

Jul. 5, 1994 [FR] France ..... 94 08382

[51] Int. Cl.[6] ..... E21B 47/01

[52] U.S. Cl. ..... 166/66; 166/50; 166/67

[58] Field of Search ..... 166/65.1, 66, 50, 166/67, 117.7, 250.01, 255.2

[56] References Cited

U.S. PATENT DOCUMENTS

| | | | |
|---|---|---|---|
| 3,288,210 | 11/1966 | Bryant | 166/66 |
| 4,171,031 | 10/1979 | Marquis | 166/66 X |
| 4,192,380 | 3/1980 | Smith | 166/66 X |
| 4,697,638 | 10/1987 | Knight | 166/65.1 |
| 4,753,291 | 6/1988 | Smith et al. | 166/65.1 |
| 4,844,161 | 7/1989 | Rankin et al. | 166/250 |
| 4,901,804 | 2/1990 | Thometz et al. | 166/66 X |
| 5,040,619 | 8/1991 | Jordan et al. | 166/50 X |

FOREIGN PATENT DOCUMENTS 36 11 374 8/1987 Germany .

*Primary Examiner*—Hoang C. Dang

*Attorney, Agent, or Firm*—Millen, White, Zelano, & Branigan, P.C.

[57] ABSTRACT

The present invention relates to a measuring assembly lowered inside a well with an operator. The assembly includes several measuring elements assembled to one another along a longitudinal axis, at least one section of which includes at least one measuring element having a coupling at both ends for assembling with the other measuring elements. The couplings include a rotary joint rotating about the longitudinal axis and the assembly further includes a device for bringing said section into rotation. In a variant, each of the assembling couplings of the section includes a rotary joint.

2 Claims, 1 Drawing Sheet

MEASURING ASSEMBLY COMPRISING MEANS FOR ORIENTING A PART OF THE MEASURING ELEMENTS

BACKGROUND OF THE INVENTION

The present invention relates to a measuring assembly consisting of an assemblage of measuring elements lowered in a well to perform what is referred to as logging operations in the profession. The assembly or sonde is generally several ten meters long. Certain measuring elements can require a particular orientation with respect to the axis of the well in order to perform measurements in a preferred direction.

In this case, the well-known technique for orienting certain measuring elements of a logging sonde consists in rotating about its axis the entire measuring assembly by applying a rotation to the operating rods at the end of which the sonde is fastened.

This operation entails several drawbacks:

Controlling the orientation of the measuring elements is difficult in wells where friction on the sonde and the rods is high. This is the case with deflected wells and particularly horizontal wells where the friction is such that the torsional deformation of the rods and of the sonde prevents precise control of the angular position.

Furthermore, under such conditions, the imperfect control of the effect of a surface rotation on the sonde can lead to a twistoff at the level of the sonde whose inertia is generally lower than that of the operating rods.

In horizontal wells notably, the weight of the sonde can be such that the rotation from the surface may be ineffective for driving the entire sonde into rotation.

SUMMARY OF THE INVENTION

The present invention thus relates to a measuring assembly lowered inside a well through operating means, said assembly comprising several measuring elements assembled to one another along a longitudinal axis, said operating means being fastened to an upper end of said assembly, at least one section comprising at least one measuring element of said assembly comprises, at both ends, means for assembling with other measuring elements. According to the invention, the assembling means at the end of the section located on the lower end side of said assembly comprises a rotary joint rotating about the longitudinal axis, and the assembly comprises means for bringing said section into rotation.

Each of the assembling means of said section can comprise a rotary joint.

The means for driving into rotation can comprise a motorization located in the neighbourhood of said section, said motorization being operated from the ground surface.

The operating means can consist of rods screwed onto one another above said elements and running up to the ground surface, the driving means can be located at the ground surface and drive said rods and said section into rotation without driving the lower end of the measuring assembly.

The operating means can consist of a cable wound on a reel at the ground surface and said cable can comprise a transmission line for transmitting measurements and controls of said motorization.

The operating means can consist of a semirigid rod wound on a reel at the ground surface and they can comprise a transmission line for transmitting measurements and controls of said motorization.

The rod can be a metallic tube.

The motorization can be fed by said transmission line.

At least one of the assembling means can comprise means for locking the rotary joint in rotation and said locking means can be controlled by means of the transmission line.

The assembly can comprise means for measuring the orientation of said section around the longitudinal axis of the assembly.

BRIEF DESCRIPTION OF THE DRAWINGS

Other features and advantages of the present invention will be clear from reading the description hereafter given by way of non limitative examples, with reference to the accompanying drawings in which.

DESCRIPTION OF THE PREFERRED EMBODIMENTS

Figure 1:
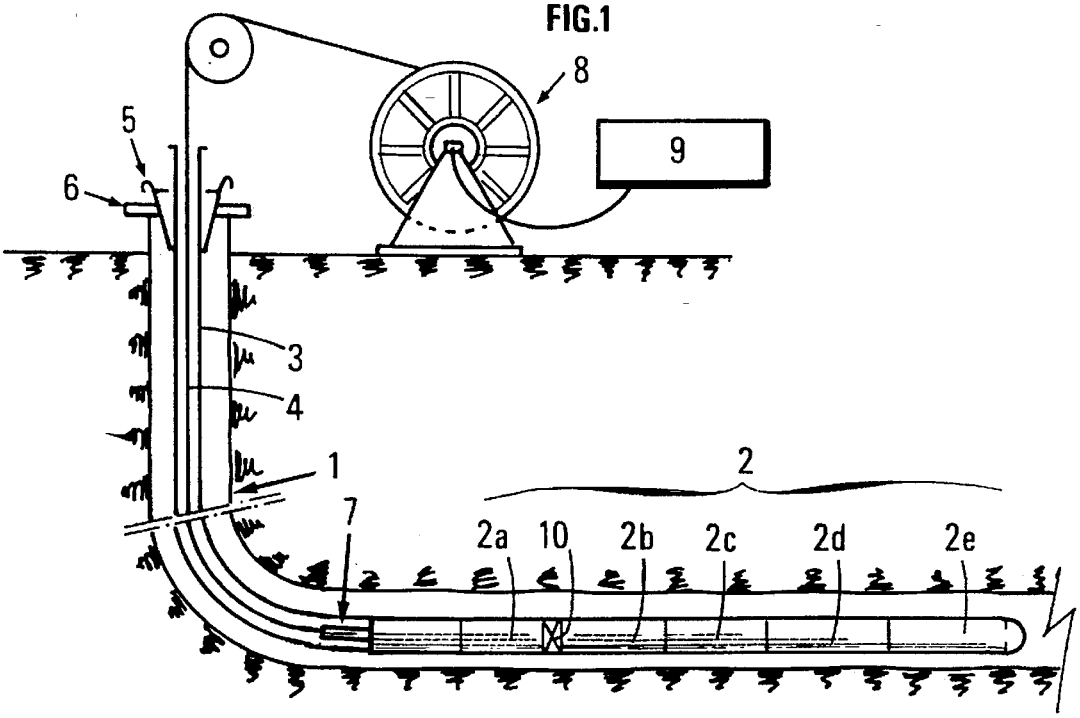
FIG. 1 shows a first embodiment of the invention.

FIG. 1 diagrammatically shows a well 1 comprising a vertical part and an inclined part, for example, practically horizontal. A measuring assembly 2 consists of an assemblage of a plurality of measuring elements 2*a*, 2*b*, 2*c*, 2*d* and 2*e*. This measuring assembly is in more or less continuous contact with the walls of the well.

The measuring assembly 2 is lowered in well 1 by means of a string 3 of drillpipes assembled to one another for setting the measuring element in the zone where measurements are to be achieved. In FIG. 1, the upper end of the string 3 of tubes is suspended by means 5 on a rotator table 6 that can rotate, and which is therefore conventionally referred to as a rotary table.

A cable 4 comprises conductors suited for transmitting the measurements and the energy necessary for the running of the measuring assembly. Cable 4 is lowered in the inner space of the pipes 3, generally by gravity and/or by pumping. A connecting device 7 allows the conductors of cable 4 to be connected to the measuring elements of assembly 2. The cable is conventionally operated from the surface by a winch 8, the conductors of the cable being connected to an installation 9 for recording and controlling the measurements achieved by assembly 2.

In this first embodiment, only one measuring element located close to the upper end of assembly 2 must be oriented in the well to perform measurements in a predetermined direction. To that effect, the means for assembling element 2*a* with element 2*b* comprises a rotary connection 10. Of course, the rotary connection 10 also comprises rotating means suited to the transmission of measurements or information passing through cable 4 towards the measuring elements of assembly 2. For example, if the cable comprises electric conductors, a rotary electric collector will co-operate with the rotary joint, their axes of rotation being identical. These mechanical means are not described in detail here since they are well-known in the profession.

In the configuration illustrated by FIG. 1, the part of assembly 2 on the lower end side provides the greatest quantity of friction on the walls of the well, because of the weight, of its length or even of measuring arms or of the centralizers in contact with the walls. The invention thus offers the advantage of allowing rotation in order to orient element 2*a* without bringing elements 2*b*, 2*c*, 2*d* and 2*e* into rotation. Rotation is thus achieved with the lowest torque possible,.

In this example illustrated by FIG. 1, the string of drill-pipes 3 can possibly comprise a side-entry sub. This sub allows cable 4 to leave the inner space of string 3 to be driven up to the surface in the annular space between string 3 and well 1. The measuring assembly 2 can thus be moved by adding or by removing pipes above the side-entry sub while maintaining continuously the link between assembly 2 and the surface by means of the conductors of cable 4 which remains connected through means 7 during pipe additions or removals.

Figure 2:
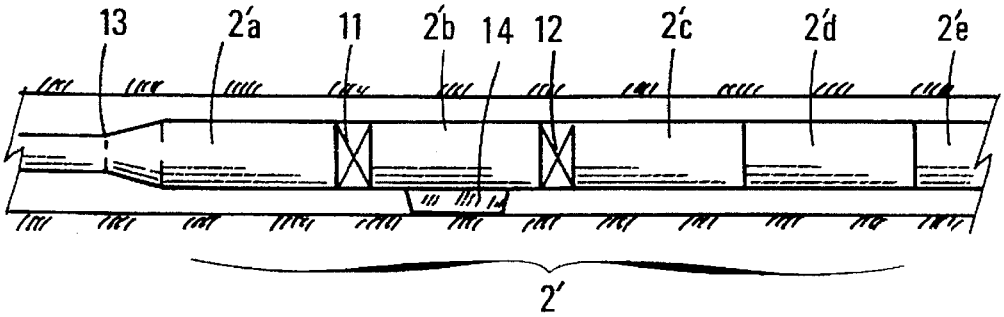
FIG. 2 shows another embodiment.

FIG. 2 shows a variant of the invention in which assembly 2' consists of a plurality of measuring elements 2'*a*, 2'*b*, 2'*c*, 2'*d*, 2'*e*. In this case, the measuring element 2'*b* is assembled to the neighbouring elements 2'*a* and 2'*c* by assembling means 11 and 12 comprising each a rotary connection and also rotary means for ensuring the continuity of the conductors connecting the measuring elements to the ground surface. One or the other of the assembling means 11 and 12, or both, can comprise devices equivalent to engaging gears whose purpose is to link in rotation two consecutive measuring elements. These engaging devices are preferably remote-controlled from the ground surface, either by means of the conductors of cable 4, or by other known information transmission systems. The section comprising the measuring element 2'*b* can also comprise a motorization located in its neighbourhood, either between the two assembling means 11 and 12, or on either side, i.e. here at the end of element 2'*a* or of element 2'*c*. Reference number 14 refers to a simple means for orienting measuring element 2'*b*: an unbalanced mass can be welded on to the body of the sonde so that element 2'*b* tends to orient under the sole action of gravity.

In the variant according to FIG. 2, the operating means 13 can preferably consist of:

- a string of pipes 3 as described previously and illustrated by FIG. 1,
- a metallic tube of the coil tubing type wound under plastic deformation on a reel,
- a continuous rod made from a composite material and wound on a reel at the surface,
- a conventional logging cable.

In these four examples of operating means 13, the transmission of the measurements and/or of the controls can pass through a cable such as that bearing reference number 4 in FIG. 1. In the case of the coil tubing, the logging cable 4 can be included in the coil tubing, or be located in the annular space if the tubing is not fitted with an electric line. In the case of the composite material rod, it can advantageously comprise a transmission line incorporated during the manufacturing of the rod.

It should be noted that, in the variants where the operating means consist of a tube, a continuous rod or a logging cable, all wound on a reel, the tube, the rod or the cable cannot be rotated about its longitudinal axis to orient the measuring element.

Figure 3:
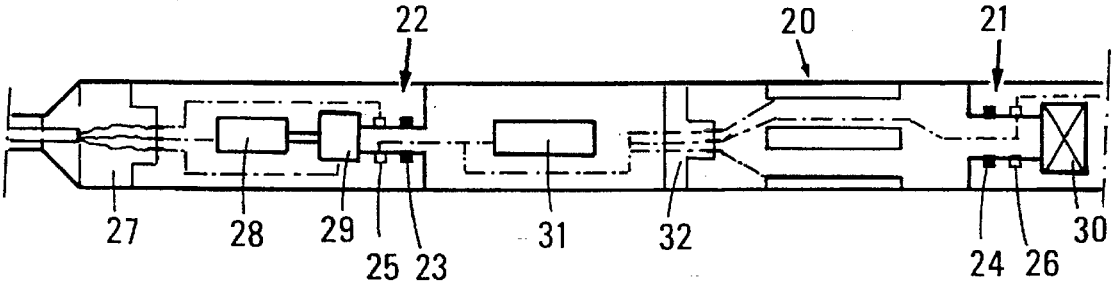
FIG. 3 diagrammatically shows a variant of a section orientation means.

FIG. 3 illustrates a variant of a measuring element 20 connected to the neighbouring elements by assembling means or couplings 22 and 21 comprising a rotary connection 23 and 24. The rotary connections 23 and 24 comprise at least one rotary electric contact 25 and 26, for example of the rotary ring type, co-operating with a brush. These rotary electric contacts allow transmission of the information, measurements, controls on either side of the assembling means 22 and 21.

The purpose of part 27 is to provide mechanical and electrical links with the operating means 13 and the transmission cable up to the surface.

A motor 28, for example electric or electrohydraulic, is activated and operated from the surface in order to rotate element 20 about its longitudinal axis so as to orient it in a predetermined direction.

A mechanical box 29 contains gear ratios for decreasing the speed and obtaining the highest rotation torque possible considering the available power. This device 29 can comprise a system of the engaging gear type for locking the rotary connection 23 in rotation. The other assembling means 21 can be fitted with the same system 30.

Reference number 31 refers to a means for controlling the angular position of the measuring element 20 with respect to the well. Control means 31, integral with measuring element 20, for example by means of a plug 32, comprises accelerometers or more simply a pendulum measuring device. These are conventional means.

Operations:

EXAMPLE 1

The device is true to the configuration of FIG. 1, the objective being to orient measuring element 2*a*. The measuring assembly 2 is lowered at the end of the string of pipes 3 by adding pipes. The measuring elements are connected electrically by moving through pumping the part of connector 7 fastened to cable 4. A side-entry sub is used or not for passing or not cable 4 in the annular space.

Once in place, string 4 is rotated by rotating at the surface the rotary table 6 from which string 4 is suspended. The measuring element 2*a* rotates in the same rotating motion, apart from the torsional deformation of the pipes, without the other elements 2*b*, 2*c*, 2*d*, 2*e* being driven into rotation, and without any resistance being provided owing to the presence of the rotary connection 10. The orientation obtained for element 2*a* is controlled at the surface by the transmission, through cable 4, of the measurement provided by a control apparatus, for example of the type bearing reference number 31 (FIG. 3). If the orientation obtained does not correspond to that which is desired, it is corrected by rotating string 3.

This system also has the advantage of leaving the major part of the measuring assembly 2 (2*b*, 2*c*, 2*d*, 2*e*) free in rotation during the lowering of assembly 2 in the well. The twisting moments provided by the longitudinal displacement of a string of pipes in a well whose trajectory can display many dog-legs are thus not likely to damage assembly 2 by torsional deformation.

A variant according to the invention can comprise a device for locking the free rotation of connection 10, for example an engaging gear normally disengaged and that can be controlled to be engaged. With this device which can be remote-controlled, the operator can, if the well conditions allow him to, bring the entire assembly 2 into rotation if he wishes to and if the measuring elements all have to be oriented with respect to the well. Such a system also allows element 2*a* to be oriented with respect to the other elements.

EXAMPLE 2

In this example, assembly 2 is true to the configuration of FIG. 2, where the element to be oriented with respect to the well or with respect to the other elements comprises two rotary connections 11 and 12 with the neighbouring elements.

The setting of assembly 2' in the well can be performed either by means of a string of pipes 3, or by means of a continuous rod, for example a coil tubing or a composite rod, or at the end of a cable, for example a logging cable. The type of operating means is important for the orienting operation. In case assembly 2' is lowered at the end of pipes assembled element by element, orientation can be performed by rotating the string of pipes from the surface, according to the same operating procedure as in example 1 when the rotary connection 11 is locked by an engaging device. In this case, the orientation of element 2'b also brings element 2'a into rotation but, as in example 1, without bringing the end elements 2'c, 2'd, 2'e into rotation. Furthermore, once connection 11 has been disengaged or unlocked, the orientation of element 2'a alone may be controlled, independently of all the others. Of course, if there is an element 2'a between element 2'b and the operating means 13, which is not obligatory in the present invention.

When the operating means cannot be driven into rotation from the surface, means of motorization in rotation such as, for example, those described and illustrated by FIG. 3, can be added to the measuring assembly. In fact, a continuous tubing or composite rod wound on a reel cannot be rotated by the rotary table, which imposes different orientation means, distinct from the operating means. The same applies if the operating means consist of a logging cable. In this latter variant, torque take-up arms are preferably fastened to the elements which do not rotate.

A simplified variant can comprise an unbalanced mass system 14 or an equivalent system that orients element 2'b with respect to the well as a function of gravity and without requiring motorization and control.

I claim:

1. A measuring assembly lowered inside the wall of a well (1) from a ground surface site by an operator (3), said assembly comprising:

a plurality of measuring elements (2*a*, 2*b*, 2*c*, 2*d*, 2*e*) assembled to one another along a longitudinal axis, said operator (3) being a pipe string fastened to an upper end measuring element (2*a*) of said assembly and rotating the upper end measuring element (2*a*) with a rotator (6) located at the ground surface site, a rotary coupling (10) disposed between the upper end measuring element (2*a*) and the other measuring elements (2*b*, 2*c*, 2*d*, 2*e*) for allowing the upper end measuring element to rotate freely with respect to the other measuring elements (2*b*, 2*c*, 2*d*, 2*e*), wherein the Other measuring elements (2*b*, 2*c*, 2*d*, 2*e*) do not rotate due to frictional engagement with the wall of the well (1).

2. An assembly as claimed in claim 1, wherein said operator includes pipes (3) threaded on to one another above said measuring elements and running up to the ground surface, said rotator (6) being located on the ground surface site to drive said pipes and said section into rotation without driving the lower end of the measuring assembly into rotation.

* * * * *